US012178298B2

(12) United States Patent
Washington

(10) Patent No.: US 12,178,298 B2
(45) Date of Patent: Dec. 31, 2024

(54) METHOD AND SYSTEM FOR VISUALLY DISPLAYING AND IDENTIFYING AN INDIVIDUAL'S LIFESTYLE PREFERENCES AND RELATIONSHIP STATUS

(71) Applicant: Republiq of Q, Ltd., Chicago, IL (US)

(72) Inventor: Marcus Joseph Washington, Glenwood, IL (US)

(73) Assignee: Republiq of Q, Ltd., Chicago, IL (US)

( * ) Notice: Subject to any disclaimer, the term of this patent is extended or adjusted under 35 U.S.C. 154(b) by 22 days.

(21) Appl. No.: 18/115,167

(22) Filed: Feb. 28, 2023

(65) Prior Publication Data

US 2024/0285044 A1 Aug. 29, 2024

(51) Int. Cl.
*A44C 9/00* (2006.01)
*A44C 25/00* (2006.01)

(52) U.S. Cl.
CPC ..... *A44C 9/00* (2013.01)

(58) Field of Classification Search
CPC ..... A44C 9/00; A44C 5/0015; A44C 9/0007; A44C 9/0053; A44C 15/00; A44C 25/00
See application file for complete search history.

(56) References Cited

U.S. PATENT DOCUMENTS

| | | | | |
|---|---|---|---|---|
| 2018/0000205 | A1* | 1/2018 | Chinowsky | G06F 3/0346 |
| 2018/0190084 | A1* | 7/2018 | Mandlakazi | G08B 7/06 |
| 2019/0166961 | A1* | 6/2019 | Sterling | A44C 5/2071 |
| 2022/0287419 | A1* | 9/2022 | Crowley | A44C 5/0084 |

* cited by examiner

*Primary Examiner* — Jack W Lavinder
(74) *Attorney, Agent, or Firm* — Rockman Videbeck & O'Connor

(57) ABSTRACT

A method and system for identifying to others the lifestyle preference and/or relationship status of an individual who is wearing a finger ring of a predetermined color or combination of colors. The color of the finger ring is selected by the wearer to identify the specific lifestyle preference and/or relationship status of the wearer of the ring.

18 Claims, 6 Drawing Sheets

| | |
|---|---|
| Blue | Heterosexual Single Male |
| Pink | Heterosexual Single Female |
| Rainbow | Single LGBTQ+ Individual |
| Purple | In a Committed Relationship |
| Yellow | Non-Binary Individual |
| Red | Stop! Do not Approach, Not Interested in a Relationship |
| Striped/Swirled | Seeking Biracial Relationship |

| | |
|---|---|
| Blue | Heterosexual Single Male |
| Pink | Heterosexual Single Female |
| Rainbow | Single LGBTQ+ Individual |
| Purple | In a Committed Relationship |
| Yellow | Non-Binary Individual |
| Red | Stop! Do not Approach, Not Interested in a Relationship |
| Striped/Swirled | Seeking Biracial Relationship |

METHOD AND SYSTEM FOR VISUALLY DISPLAYING AND IDENTIFYING AN INDIVIDUAL'S LIFESTYLE PREFERENCES AND RELATIONSHIP STATUS

TECHNICAL FIELD

The present invention relates to a method and system that provides an individual a way to identify to others a lifestyle preference and/or relationship status. In particular, the present invention allows the individual to wear a finger ring or two of a specific color or colors, the color or color combination identifying the present lifestyle preference and/or relationship status of the individual.

BACKGROUND

In today's society, individuals have many lifestyle preferences that are either natural to that individual or are a lifestyle chosen by that individual. However, by merely observing an individual, an observer cannot determine the lifestyle preference or relationship status of the individual from outward appearances. This may, and often does, result in the observer mistaking the nature of any discourse, contact or relationship that the individual may be seeking with the observer, and vice versa. This mistake of identity often lead to statements made by the observer that are offensive to the individual.

Therefore, a method and system is needed that provides an individual a way to outwardly indicate their specific lifestyle preference and relationship status so that the observer is immediately aware of the individual's lifestyle and status, and that enables communication between compatible individuals.

SUMMARY

A method and system for identifying to others the lifestyle preference and relationship status of a wearer of a ring of a predetermined color or combination of colors. The color or colors of the ring displays to others in close proximity to the wearer the lifestyle preference and relationship status of the individual wearing the ring. The different colors or color combinations of the ring are selected by the individual wearer in accordance with the lifestyle preference and relationship status of the wearer.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION

Figures 1, 2:
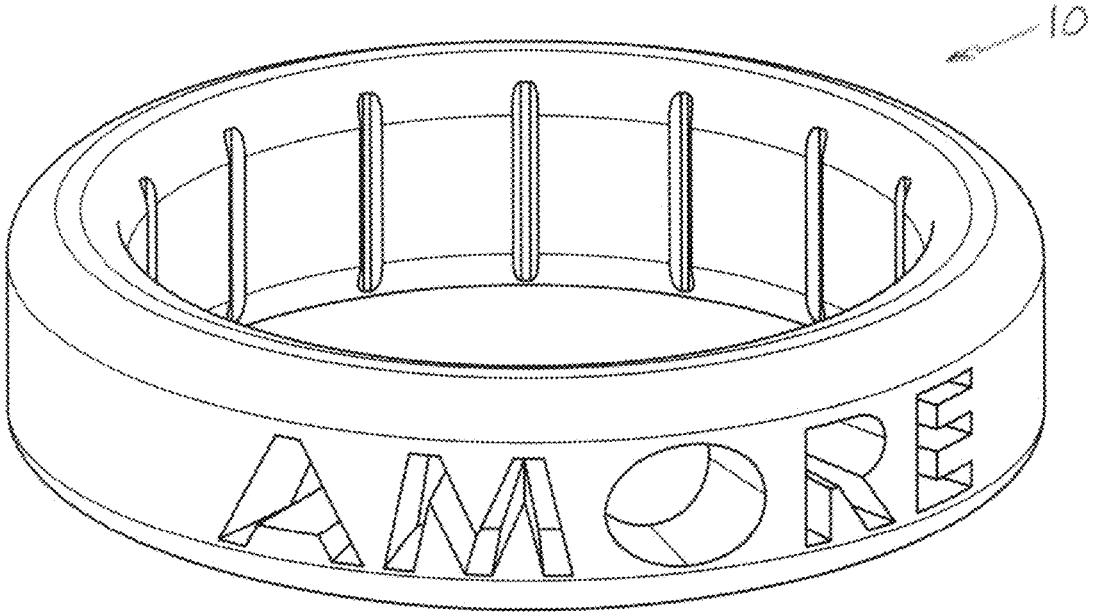
FIG. 1 is a perspective view of a jewelry ring used in association with the present invention, shown without any color.
FIG. 2 is a chart depicting the lifestyle preference and/or relationship status of the wearer of the ring of FIG. 1.
Figure 3:
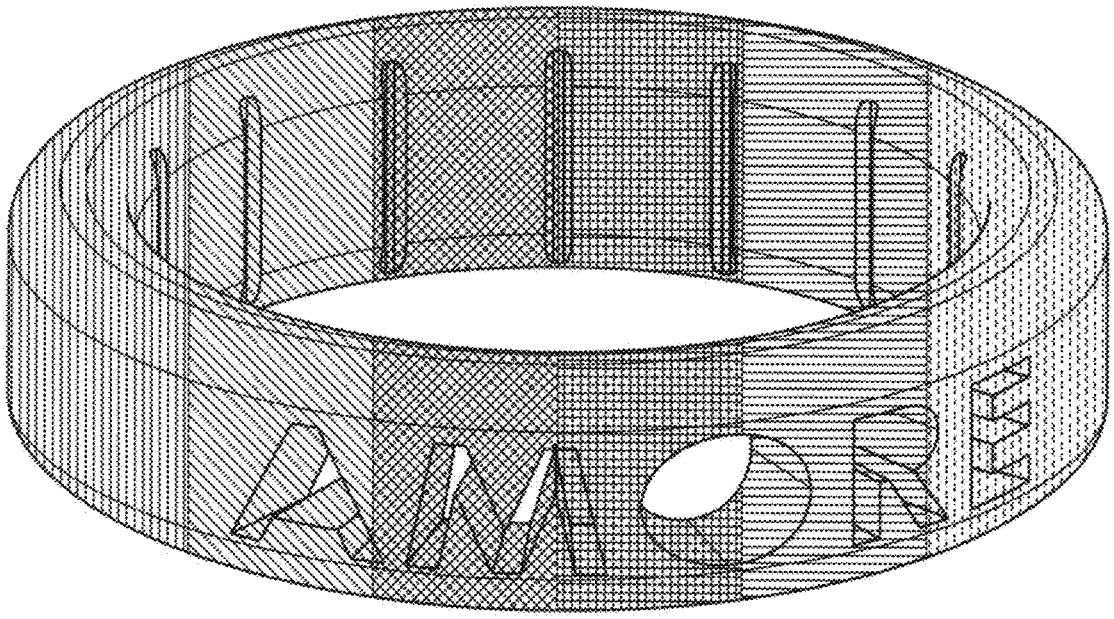
FIG. 3 is an embodiment of the ring of FIG. 1 used in association with the present invention, with lined patterns illustrating the colors of the rainbow on surfaces of the ring.
Figure 4:
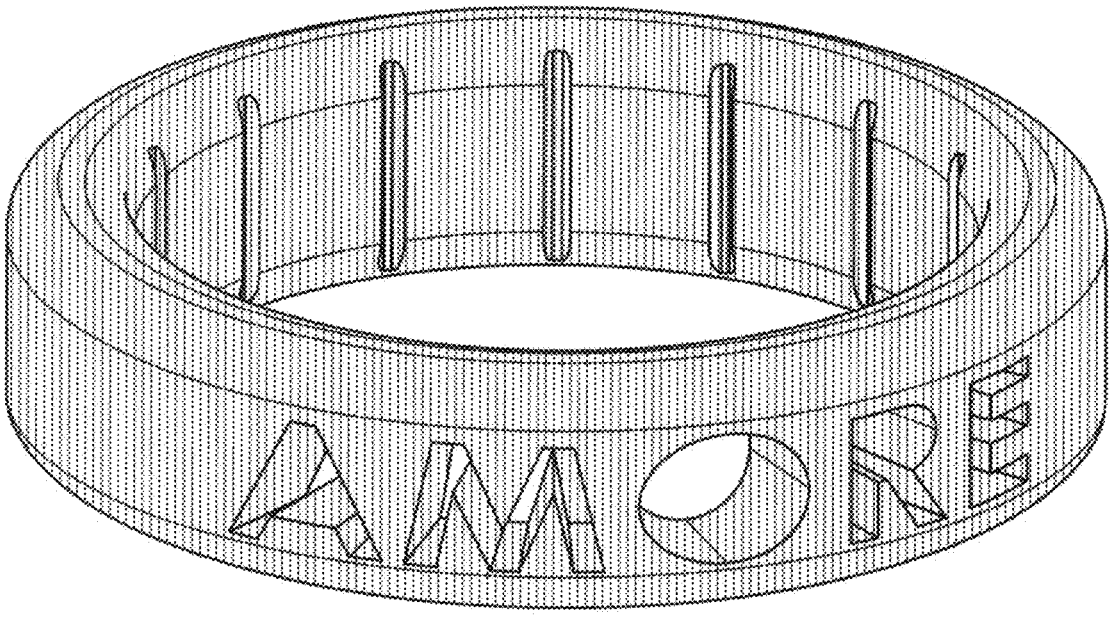
FIG. 4 is an embodiment of the ring of FIG. 1, with lined patterns illustrating the color pink on surfaces of the ring.

By wearing one or two of the patterned rings 10 of different colors illustrated in FIGS. 3 to 8 and 11 as described above, an individual an immediately convey to an observer the lifestyle preference and/or relationship status of the wearer of the ring or rings 10, such as the sexual orientation and/or racial preference of the wearer. In accordance with the present invention and as shown in FIG. 2, the wearer can select a ring of a specific color or combination of colors according to the lifestyle preference and relationship status the wearer wants to convey to an observer. The rings shown in the illustrated embodiments can be made from food grade silicone, rubber, plastic or other suitable materials as is known in the art.

FIG. 1 illustrates a generic exemplar form of a ring 10 of the present invention. The ring 10 shown is not exclusive to the present invention. A ring of any configuration, size, outer design or shape may be used. The ring 10 may include a design, as shown in FIG. 1, have plain smooth surfaces, be embedded with gemstones, or have a raised design embossed on the outer surface of the ring 10. In the present invention, the color or color combination in the surfaces of the ring conveys the lifestyle preference and relationship status of the wearer, not the physical structure of the ring 10.

FIG. 2 is a chart showing the lifestyle preference and relationship status of the wearer of the ring 10 as indicated by the various colors of the ring 10 or the color combination of the surfaces of ring 10.

Figure 5:
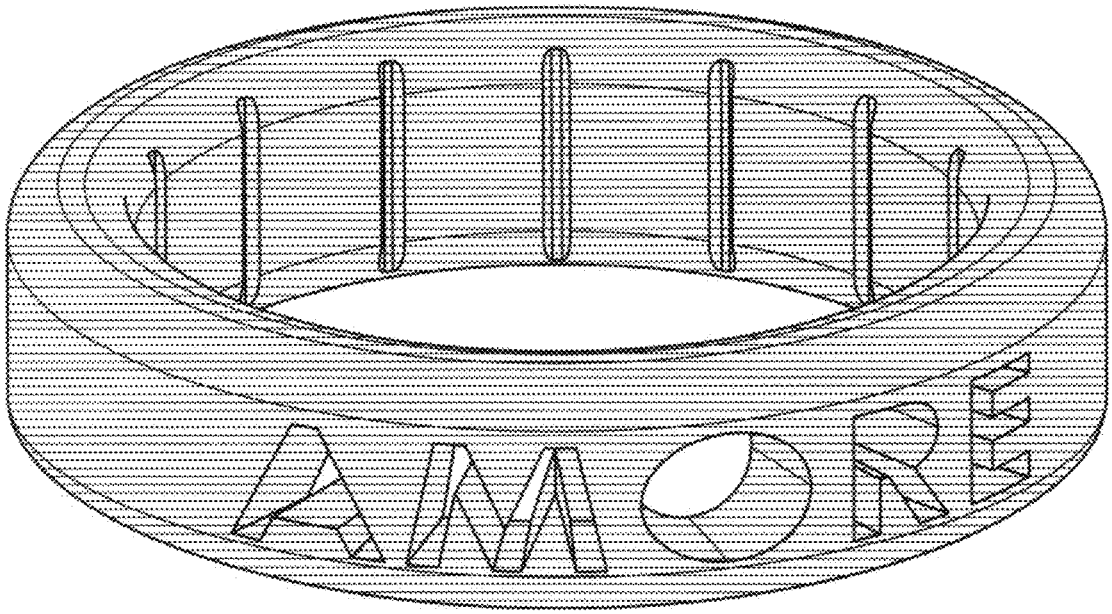
FIG. 5 is an embodiment of the ring of FIG. 1, with lined patterns illustrating the color blue on surfaces of the ring.
Figure 6:
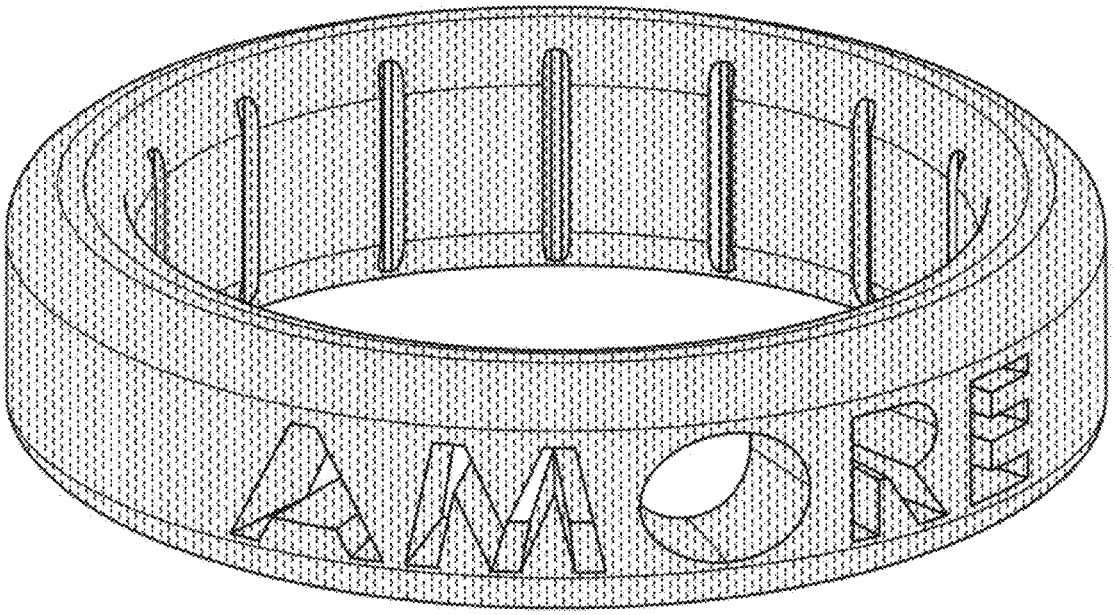
FIG. 6 is an embodiment of the ring of FIG. 1, with lined patterns illustrating the color purple on surfaces of the ring.
Figure 7:
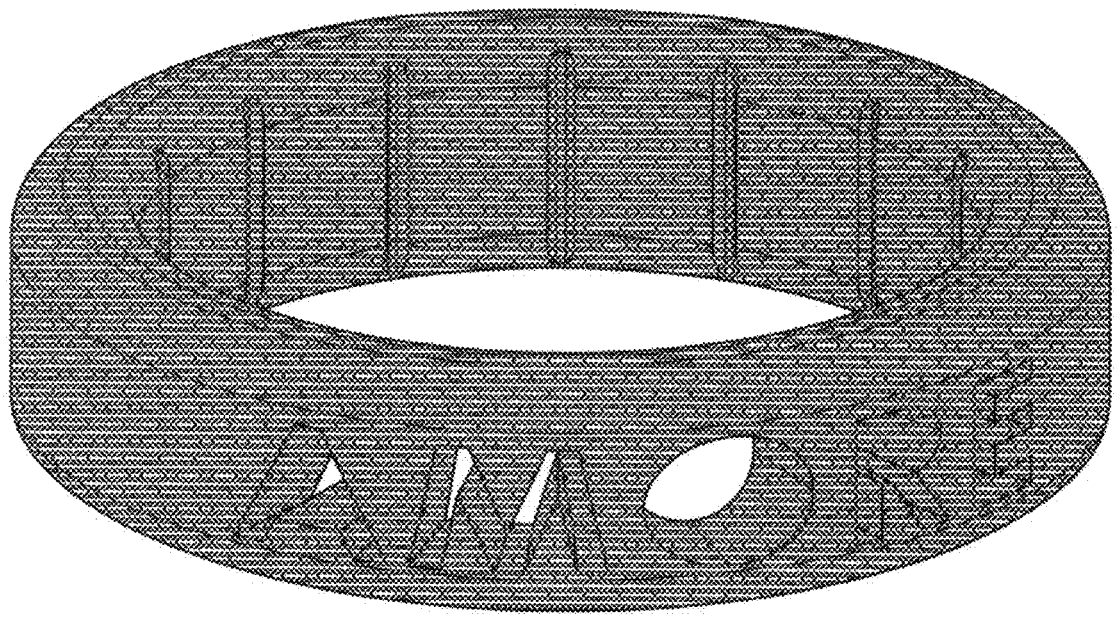
FIG. 7 is an embodiment of the ring of FIG. 1, with lined patterns illustrating the color yellow on surfaces of the ring.
Figure 8:
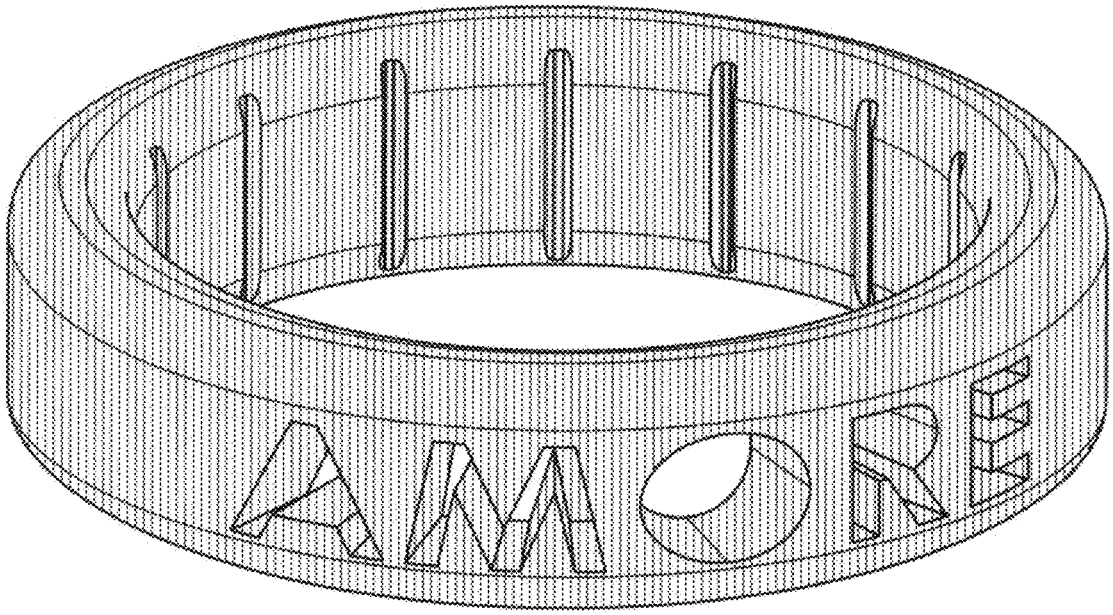
FIG. 8 is an embodiment of the ring of FIG. 1, with lined patterns illustrating the color red on surfaces of the ring.

Referring to FIG. 5, wearing a blue ring conveys to the observer that the wearer identifies as a heterosexual single male. Wearing a pink ring (FIG. 4) conveys to the observer that the wearer identifies as a heterosexual single female. Wearing a rainbow multicolor ring (FIG. 3) conveys to the observer that the wearer identifies as a single LGBTQ+ individual.

Wearing a purple ring (FIG. 6) conveys to the observer that the wearer is in a committed relationship with another person. Wearing a yellow ring (FIG. 7) conveys to the observer that the wearer is a non-binary individual. Wearing a red ring (FIG. 8) conveys to the observer that the wearer is not interested in a personal or romantic relationship with the observer or anyone else.

Figure 9:
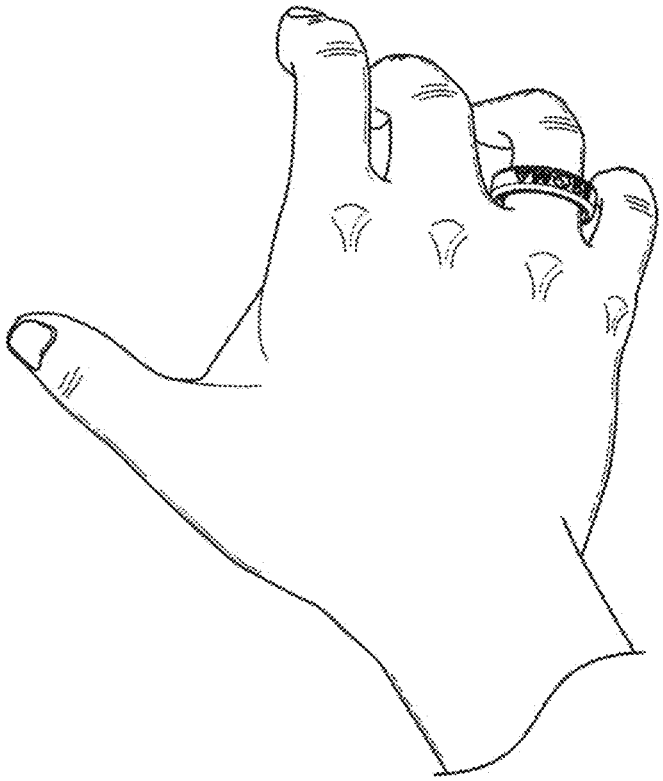
FIG. 9 is an illustration of a hand with one of the rings of the present invention worn on the ring finger of the hand.
Figure 10:
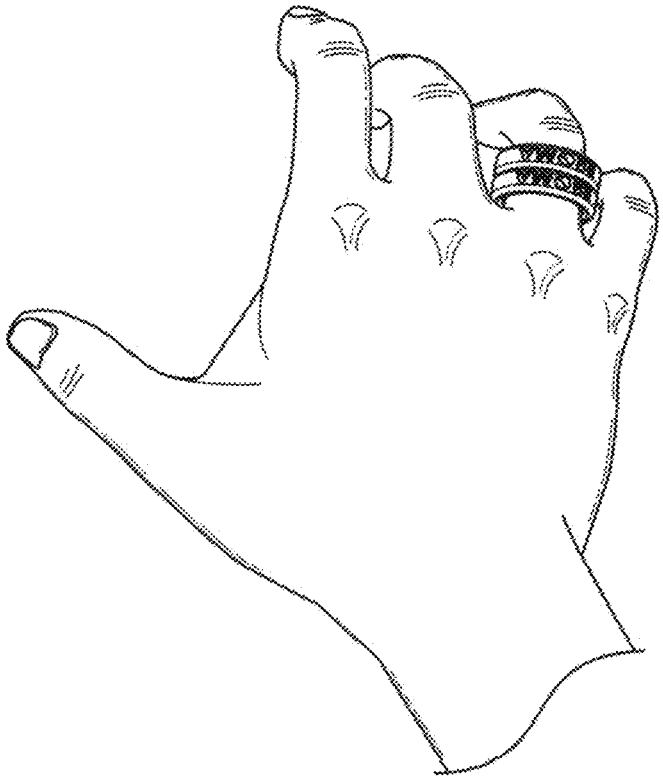
FIG. 10 is an illustration of a hand with two of the rings of the present invention worn on the ring finger of the hand.

FIG. 9 illustrates an individual wearing a single ring 10 of a selected color or color combination. However, as shown in FIG. 10, an individual may choose to wear the purple ring (FIG. 6) together with another of the colored rings to convey to the observer the orientation of one's committed relationship. For example, wearing the purple and rainbow ring would convey to the observer that the wearer was in a committed LGBTQ+ relationship.

Figure 11:
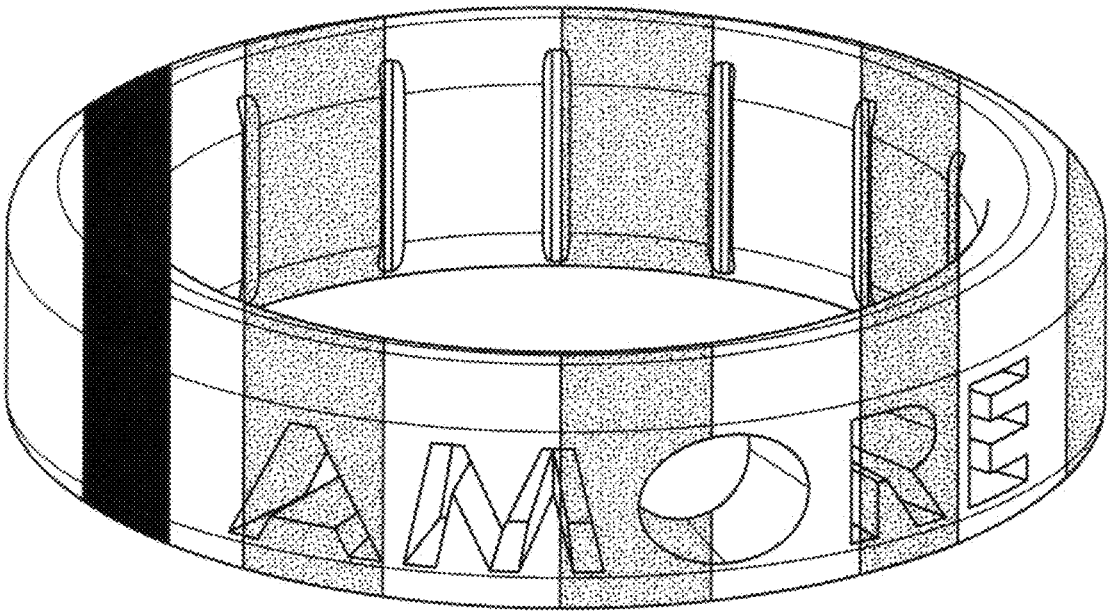
FIG. 11 is an embodiment of the ring of FIG. 1, with alternate colored lined patterns on surfaces of the ring.

FIG. 11 illustrates the ring 10 of FIG. 1 with alternate colored stripes providing lined patterns on the surface of the ring 10. In this embodiment, the striped lines are illustrated as alternating black and white stripes. However, any combination of two colors may be used. Further, a swirled combination of colors may be used. The striped or swirled pattern on the ring 10 conveys to the observer that the individual wearing the ring is interested in a biracial relationship.

The described invention comprises a method and system of wearing color coded rings to inform others of an individual's lifestyle preference and relationship status, while enabling the possible connection of compatible individuals.

While reference has been made to various illustrated embodiments of the invention, other variations are comprehended by the broad scope of the appended claims. Some of these embodiments have been discussed in detail in this specification and others will be apparent to those skilled in the art. All such variations and alterations are comprehended by this specification and are intended to be covered, without limitation. We intend the scope of this invention to not be defined by the specification, but by the claims set forth below.

The invention claimed is:

1. A method of identifying to others a lifestyle status and/or relationship status of an individual comprising the steps of:

selecting a wearable ring from a plurality of rings, the wearable ring having one of a predetermined base color and a predetermined base color pattern, wherein said one of the predetermined base color and predetermined base color pattern selected by the individual is defined on a chart associating the lifestyle preference and/or relationship status of an individual with the predetermined base colors and/or predetermined base color patterns and an indication of at least one of the lifestyle status and relationship status of said individual;

placing the wearable ring on one finger of the individual; and displaying the wearable ring to others in visual proximity to the individual.

2. The method of claim 1, wherein the ring is colored blue identifying that the wearer is a heterosexual single male.

3. The method of claim 1, wherein the ring is colored pink identifying that the wearer is a heterosexual single female.

4. The method of claim 1, wherein the ring is colored with all of the colors of the rainbow, identifying that the wearer is a single LGBTQ+ individual.

5. The method of claim 1, wherein the ring is colored purple, identifying that the wearer is in a committed relationship.

6. The method of claim 1, wherein the ring is colored yellow, identifying the wearer as a non-binary individual.

7. The method of claim 1, wherein the ring is colored red identifying the wearer as not interested in a relationship.

8. The method of claim 1, wherein the ring is colored with one of a two-color striped and two-color swirled pattern, identifying that the wearer has interest in a biracial relationship.

9. The method of claim 1, wherein the ring is made of a material selected from the group consisting of food grade silicone, rubber and plastic.

10. A system of identifying to others a lifestyle preference and/or relationship status of an individual, comprising:

a plurality of wearable rings adapted to be worn on a finger of the individual;

each of the plurality of rings comprising one of a predetermined and different base color and a predetermined combination of base colors;

a chart associating the lifestyle preference and/or relationship status of an individual with each of the predetermined base colors and/or the predetermined combination of base colors; and the one of the different predetermined base colors and the combination of predetermined base colors identifying one of a lifestyle preference and a relationship status of the individual wearing one of the plurality of wearable rings.

11. The system of claim 10, wherein:

the ring is colored blue identifying the individual as a heterosexual single male.

12. The system of claim 10, wherein:

the ring is colored pink, identifying the individual as a heterosexual single female.

13. The system of claim 10, wherein:

the ring is colored with all of the colors of the rainbow, identifying the individual as a single LGBTQ+ person.

14. The system of claim 10, wherein:

the ring is colored purple identifying that the individual is in a committed relationship.

15. The system of claim 10, wherein:

the ring is colored yellow, identifying that the individual is a non-binary person.

16. The system of claim 10, wherein:

the ring is colored red identifying that the individual is not interested in a relationship.

17. The system of claim 10, wherein:

the ring is colored with one of a two-color striped and two color swirled pattern, identifying that the individual is interested in a biracial relationship.

18. The system of claim 10, wherein:

the ring is made of a material selected from the group consisting of food grade silicone, rubber and plastic.

* * * * *